US005954282A

United States Patent [19]

Britzke et al.

[11] Patent Number: 5,954,282

[45] **Date of Patent: *Sep. 21, 1999**

[54] PLATE FOR REDUCING WEAR BY A MATERIAL FLOW

[76] Inventors: Robert W. Britzke, 106 Woodrock La., Rogers, Ark. 72756; Neil R. Hise, 10 Calle de Arroyo, Placitas, N.Mex. 87043

[ * ] Notice: This patent issued on a continued prosecution application filed under 37 CFR 1.53(d), and is subject to the twenty year patent term provisions of 35 U.S.C. 154(a)(2).

[21] Appl. No.: 08/796,431

[22] Filed: Feb. 10, 1997

[51] Int. Cl.[6] ..... B02C 19/00

[52] U.S. Cl. ..... 241/275

[58] Field of Search ..... 241/275, 294

[56] References Cited

U.S. PATENT DOCUMENTS

| | | | |
|---|---|---|---|
| 2,635,309 | 4/1953 | Smith . | |
| 2,687,875 | 8/1954 | Morlan et al. | 241/294 |
| 3,023,973 | 3/1962 | Conley et al. . | |
| 3,058,679 | 10/1962 | Adams . | |
| 3,065,920 | 11/1962 | Johnson et al. | 241/294 |
| 3,107,867 | 10/1963 | Svensson et al. | 241/294 |
| 3,679,144 | 7/1972 | Bogle | 241/300 |
| 3,955,767 | 5/1976 | Hise | 241/275 |
| 4,690,341 | 9/1987 | Hise et al. | 241/275 |
| 4,787,564 | 11/1988 | Tucker | 241/275 |
| 4,848,681 | 7/1989 | Eriksson et al. | 241/183 |
| 4,940,188 | 7/1990 | Rodriguez et al. | 241/275 |
| 5,174,513 | 12/1992 | Rose et al. | 241/275 |
| 5,269,477 | 12/1993 | Buchholtz et al. | 241/294 |
| 5,497,951 | 3/1996 | Watajima | 241/275 |

*Primary Examiner*—Mark Rosenbaum

[57] ABSTRACT

A plate for reducing wear by a material flow, according to the present invention, includes a body having at least one surface exposed to a material flow. At least one bore is formed in the body through the surface of the body exposed to the material flow. Also included is at least one rod which has a distal end and a proximal end. The rod is immovably secured in the bore. The distal end of the rod is positioned a distance beyond the surface of the body exposed to the material flow.

5 Claims, 2 Drawing Sheets

FIG. 1
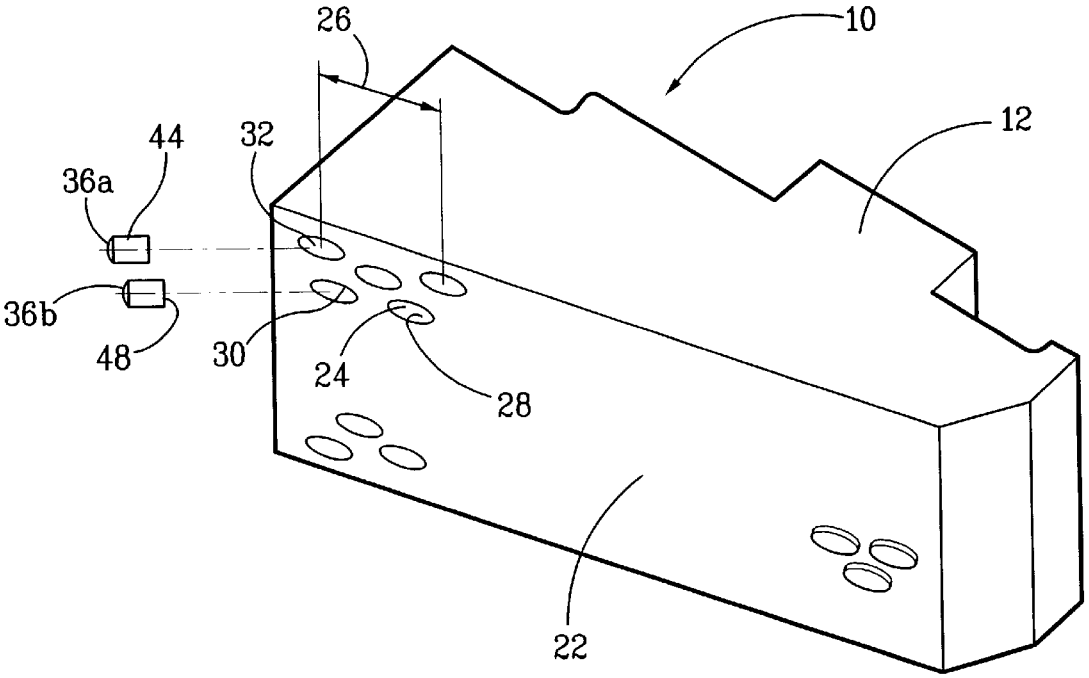
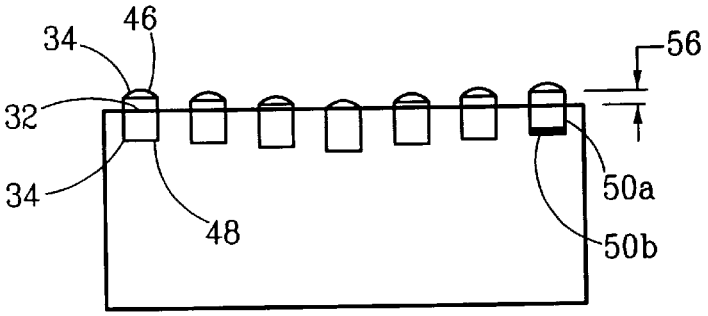
FIG. 2

PLATE FOR REDUCING WEAR BY A MATERIAL FLOW

CROSS-REFERENCE TO RELATED APPLICATION

None.

FEDERALLY SPONSORED RESEARCH AND DEVELOPMENT

None.

FIELD OF THE INVENTION

The present invention pertains generally to the field of reducing wear to a surface caused by a material flow. More particularly, the present invention pertains to a plate for reducing wear of components of an impact crusher caused by an aggregate flow. The present invention is particularly, but not exclusively, useful for reducing wear of component parts of impact crushers caused by earth aggregate flows during operation of impact crushers.

BACKGROUND OF THE INVENTION

Fluid, gas and material movement may create streams and flows of materials which abrade, degrade, fatigue and wear out a wide variety of components of apparatus. Wear may be caused by friction, impact, pulsation, wave action, grinding, and other actions by a material, fluid and gas flow (collectively, "material flow") against, across, and around one or more surfaces of a component in an apparatus. Regardless of the precise nature or function of an apparatus in which components are subjected to wear by a material flow, wear causes repair and replacement of components, and delays in use of the apparatus while one or more worn components is identified, inspected, removed, and replaced. Wear of components adds to the expense of maintaining and operating the apparatus. Such delays, costs and expenses are compounded if the apparatus in which wear occurs is located at a remote site.

For example, a wide variety of impact crushers are used in commerce to reduce the size of larger earth materials to smaller sized and shaped aggregate. The construction industry trades employ a variety of impact crushers to reduce large aggregate to aggregate sizes and shapes required to satisfy construction specifications for mixtures and admixtures of aggregate with cement and other ingredients, and for further processing of size reductions, chemical leaching, and other stages of use. Construction industry use of impact crushers is but one example of the need to reduce wear by a materials flow in apparatus used to affect the size of particles in the materials flow, to make substantially uniform the size of particles in a materials flow, and to prepare materials for further processing.

Generally, impact crushers provide a device for introducing aggregate into a device for crushing the aggregate. Most impact crushers are designed to rely on centrifugal force to disperse large aggregate through the crusher, and to impact the aggregate against a wide variety of impact crusher components to break up, reduce in size, and ultimately eject from the crusher, aggregate composed of desired shapes, sizes and consistency. Intense efforts have been devoted to improvements in the design and construction of components of impact crushers to reduce the cost of acquiring and operating crushers, to enhance wear resistance of the component parts of crushers, and to facilitate rapid replacement of worn parts of crushers to enable the user of crushers to lose the least possible amount of time during which a crusher is inoperative due to worn parts.

Such improvements are exemplified by those shown in U.S. Pat. No. 3,955,767 issued May 11, 1976 to Mason R. Hise, and U.S. Pat. No. 4,690,341 issued Sep. 1, 1987 to Mason R. Hise and Neil R. Hise, the latter being one of the inventors herein (collectively, the "Hise Patents"). The Hise Patents are instructive on the number and variety of components which may be included in an impact crusher and consequently exposed to wear during operation of an impact crusher. All components of an impact crusher exposed to a material flow of aggregate as exemplified in the Hise Patents, and other impact crushers, are subject to abrasion, decomposition, fracture, friction, impact, pulsation, wave action, grinding, and other actions causing wear to components of an impact crusher is due to the velocity, acceleration and composition of aggregate flows against, across and around the components during operation of a crusher (collectively, "wear"). For example, an impeller of an impact crusher may receive and hurl aggregate against one or more crusher components generally known in the art as anvils. An impeller of an impact crusher is known to rotate at speeds from about 500 to about 2000 RPM. The rotation of an impeller, in combination with centrifugal force, creates a material flow of aggregate consisting of a variety of sizes and shapes of aggregate being projected at, over and around many of the components of the crusher. It is significant that persistent wear occurs not just on anvils, which are designed to cooperate with other crusher components in crushing aggregate, but also on any other component of an impact crusher which may be exposed to the aggregate flow during operation of the crusher.

As a result of persistent wear caused by material flows, components of crushers must be replaced. Replacement of components causes "down time" to repair, refit, and replace components. Additional expenses are associated with replacing the worn part or component, inventorying replacement components, and delivering a replacement component to what is often a remote site, to say little of the general frustration associated with having to stop the aggregate crushing process to replace worn components.

In addition to an impeller included in an impact crusher, an impact crusher may include a housing containing a rotatable impeller assembly. An impeller may include but are not limited to one or more impeller tables, one or more impeller covers, and brackets holding and connecting the tables and covers. An impact crusher may be designed to use shoes attached to an impeller assembly. The shoes, in combination with centrifugal force, hurl and direct an aggregate flow generated by operation of an impeller assembly against one or more anvils located within the crusher. One or more anvils assist in crushing, breaking up and reducing in size the aggregate material in the aggregate flow. The crusher housings, impeller tables, impeller plates, brackets, shoes and anvils, as well as all other components of an impact crusher which cooperate with such components, are subject to wear by aggregate flows. As will be clear to one skilled in the art, crushers may include a wide variety of other components which may be exposed to and impacted by aggregate, causing significant wear in those components.

What is needed, therefore, is a device for reducing wear of components of apparatus exposed during operation to a material flow. Particularly what is needed is a device for reducing wear of components of an impact aggregate crusher during operation by a material flow of aggregate.

In light of the above, it is an object of the present invention to provide a plate and surface which, when exposed to material flows during operation of impact crushers, will increase wear life of components by resisting wear by a material flow across, over and around the plate and surface of the plate.

However, cost also is a significant consideration. The components of impact crushers, for example, could be manufactured of alloys of metals which would be virtually nondegradable, but the cost of manufacturing and buying such components would be prohibitive. Therefore, it is another object of the present invention to provide a plate for reducing wear of components of impact crushers during operation which is cost effective and economical.

Another object of the present invention is to provide a plate for reducing wear to components which is composed of metals and metal alloys rather than materials which may be merely elastomeric.

Yet another object of the present invention is to provide a plate for reducing wear to components which is a complete body rather than merely elements or subassemblies which require assembly or bonding by chemical or mechanical means into an assembly for use to reduce wear by a material stream.

Still another object of the present invention is to provide a plate for reducing wear of components of impact crushers during operation, and a method for manufacturing a device for reducing wear of components of impact crushers during operation, which respectively are easy to use and to practice, and which are cost effective for their intended purposes.

These and other objects, features, and advantages of such a plate for reducing wear by a material flow will become apparent to those skilled in the art when read in conjunction with the accompanying following detailed description, drawing figures, and appended claims.

SUMMARY OF THE INVENTION

A plate for reducing wear caused by a material flow, according to the present invention, includes a body. The body has at least one surface of the body exposed to a material flow during operation of an apparatus of which the body is a part. The body may be but is not limited to any one or more of the components exposed to an aggregate flow during operation of an aggregate impact crusher. Thus, a body may include one or more impeller tables, one or more impeller covers attached to the impeller tables, and brackets holding and interconnecting the tables and covers. Also, a body may be attached to an impeller assembly to assist in projecting and directing an aggregate flow against, over or around another embodiment of a body designed for crushing, fracturing, breaking up and reducing in size and shape large aggregate into smaller sizes and shapes. In an impact crusher, a body also may be an anvil, which typically is a component having a plane against which an aggregate flow is directed. A body also may be other components of an aggregate crusher, including but not limited to housings and brackets, all of which are subject to wear by an aggregate flow. As will be clear to one skilled in the art, impact crushers include a wide variety of other components which may be exposed to and subject to wear by an aggregate flow, causing wear.

The plate for reducing wear by a material flow, according to the present invention, also includes at least one surface of the body which is exposed to a material flow. For example, in a plate of a component associated with an impact aggregate crusher, the plate includes a body having one or more surfaces exposed to an aggregate flow within the impact crusher during operation of the crusher. As will be evident from one skilled in the art, the plate may have more than one surface which, during operation, is or may be exposed to a material flow.

Also included in the plate for reducing wear by a material flow, according to the present invention, is at least one bore. A bore is formed in the body through a surface which may be exposed to a material flow. For example, in a component of an impact crusher, a bore is formed in a body of a component of an impact crusher through a surface which may be exposed to a material flow during operation of an impact crusher. Neither the shape nor dimension of the bore is significant to the present invention. In the embodiment shown in the accompanying drawing, the bore is shown as being substantially cylindrical. However, the cylindrical shape of the bore is merely one embodiment of a number of sizes and shapes of a bore. Depending on the shape, configuration, and location of the body, the body may be formed with more than one bore to provide a pattern or matrix of bores in the body on a surface exposed to a material flow. A bore formed in the body through a first surface which may be exposed to a material flow may be formed with a closed bottom, or the bore may extend through the body and through a second surface of the body which may or may not be likewise exposed to a material flow during operation of the apparatus.

A bore may be formed in the body of a plate, through a surface exposed to a material flow, by any of a number of ways, including but not limited to drilling, reaming, countersinking or incision by thermal means. In one embodiment of the present invention, the bore does not extend through the body of the plate. The bore is formed with an inner face and a first edge formed between the intersection of the inner face of the bore and the surface of the plate which is exposed to aggregate flow during operation of the crusher. In that embodiment of the present invention, the bore formed in the body of the plate also provides a surface opening and a closed bottom. In another embodiment of the present invention, the bore formed in the body through a first surface which is exposed to a material flow may extend through the body and through a second surface of the body which may or may not be likewise exposed to a material flow during operation of the apparatus. While the accompanying drawing discloses a matrix of bores configured to be equidistant from axes through the centers of the bores, location of the bores in that pattern is merely illustrative of one embodiment of a number of possible matrixes of the bores, is not intended to be exclusive, and is not a limitation of the present invention.

A plate for reducing wear by a material flow, according to the present invention, also includes at least one rod. The rod has a distal end and a proximal end. In accordance with one embodiment of the present invention, the proximal end of the rod is designed to be secured immovably in the bore. To achieve the objects of the present invention, the proximal end of the rod is inserted into a bore of the body of the plate to position the distal end of the rod a distance beyond the surface of the plate exposed to a material flow. If more than one rod is inserted into more than one bore of a surface exposed to a material flow, the distance each rod extends beyond the surface exposed to the material flow need not be uniform. In another embodiment of the present invention, the proximal end of the rod inserted through the first surface of the body into the bore may extend to, or may extend a second distance beyond a second edge formed between the intersection of the inner surface of the bore and the second surface of the body. The second surface of the body may or may not be exposed to a material flow during operation of the apparatus in which the body in assembled.

An embodiment of a plate for reducing wear by a material flow, according to the present invention, provides for a rod manufactured by powder metallurgy techniques. However, manufacture of a rod by powder metallurgy techniques is merely one embodiment of a rod useful in connection with the present invention, is not intended to be exclusive, and is not a limitation of the present invention.

The body of the plate, according to the present invention, is composed primarily of ferrous materials. However, use of a ferrous material is merely one embodiment of the materials which may be used to compose the body, is not intended to be exclusive, and is not a limitation of the present invention.

The plate, according to the present invention, deflects, interrupts, and disperses a material flow against, across, over and around the body of the plate, contributing to significant reduction of wear of components of an impact crusher. The plate also reduces wear caused by a material flow because, in one embodiment of the present invention, the one or more rods inserted into the one or more bores of the body is made of one or more wear resistant alloys.

The novel features of this invention, and the invention itself, both as to structure and operation, are best understood from the accompanying drawing, considered in connection with the accompanying description of the drawing, in which similar reference characters refer to similar parts, and in which:

BRIEF DESCRIPTION OF THE DRAWING

FIG. 1 is a perspective view of a component of an impact crusher showing a plate for reducing wear by a material flow in an operative environment;

FIG. 2 is a cross-sectional view of an alternative embodiment of a plate for reducing wear by a material flow;

DESCRIPTION OF THE PREFERRED EMBODIMENTS

Figure 3:
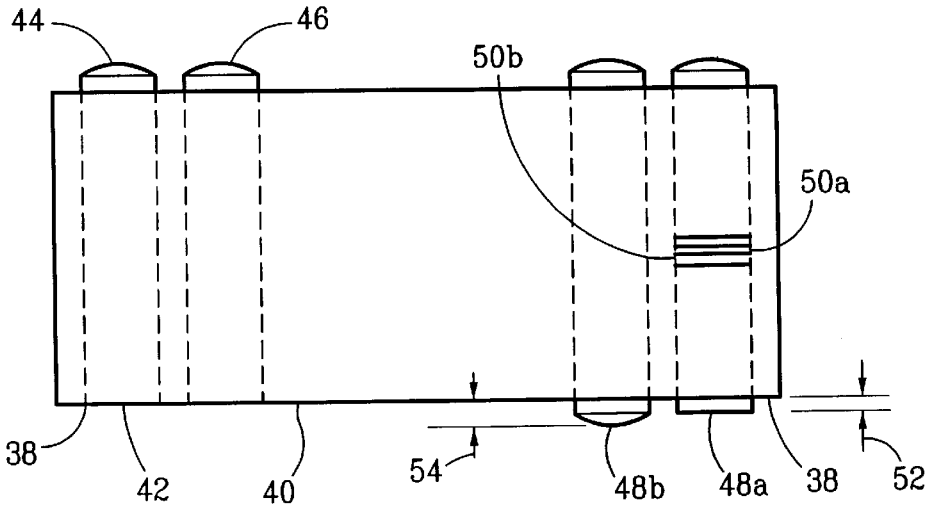
FIG. 3 is a cross-sectional view of another alternative embodiment of a plate for reducing wear by a material flow.

Referring initially to FIG. 1, the plate for reducing wear by a material flow, according to the present invention, is shown and generally designated 10. As shown, plate 10 for reducing wear by a material flow includes a body 12. Body 12 may be but is not limited to a component of an impact crusher (not shown) exposed to a material flow of aggregate during operation of an impact crusher. Thus, referring to FIG. 4, body 12*a* of plate 10 is shown to be a component 14 of an impact crusher, but body 12 of plate 10 may be an impeller table 16, an impeller cover 18 attached to impeller table 16, or a bracket 20 holding and interconnecting table 16 and cover 18. Also, as shown by cross-reference between FIGS. 1 and 3, body 12 may be attached to impeller table 16 to assist in projecting and directing an aggregate flow against, over or around an anvil (not shown) of an impact crusher for crushing, fracturing, breaking up and reducing in size and shape large aggregate into smaller sizes and shapes. Body 12 also may be any other component of an apparatus with components exposed to wear by a materials flow during operation of the apparatus. As will be clear to one skilled in the art, impact crushers include a wide variety of other components which may be exposed to and subject to wear by an aggregate flow, causing significant wear.

Plate 10 for reducing wear by a material flow, according to the present invention, also includes at least one first surface 22 exposed to a material flow during operation of the apparatus with which body 10 is associated. For example, body 12 of plate 10 includes at least one first surface 22 exposed to an aggregate flow within an impact crusher during operation of the crusher. As will be evident from one skilled in the art, plate 10 may have more than one surface which, during operation, is or may be exposed to a material flow.

Also included in plate 10 for reducing wear by a material flow, according to the present invention, as shown in FIG. 1, is at least one bore 24. Bore 24 is formed in body 12 of plate 10 through first surface 22 which may be exposed to a material flow. Thus, bore 24 is formed in body 12 of plate 10 through first surface 22 which may be exposed to a material flow during operation of an impact aggregate crusher. Neither the shape nor any dimension of bore 24 is significant to the present invention. In the embodiment shown in FIG. 1, bore 24 is shown as being substantially cylindrical. However, the cylindrical shape of bore 24 is for illustrative purposes only, and is merely one embodiment of a number of sizes and shapes of bore 24. Depending on the shape, configuration, and location of body 12, body 12 may be formed with more than one bore 24 to provide a pattern of bores 24 in body 12 through first surface 22 exposed to a material flow.

Figure 4:
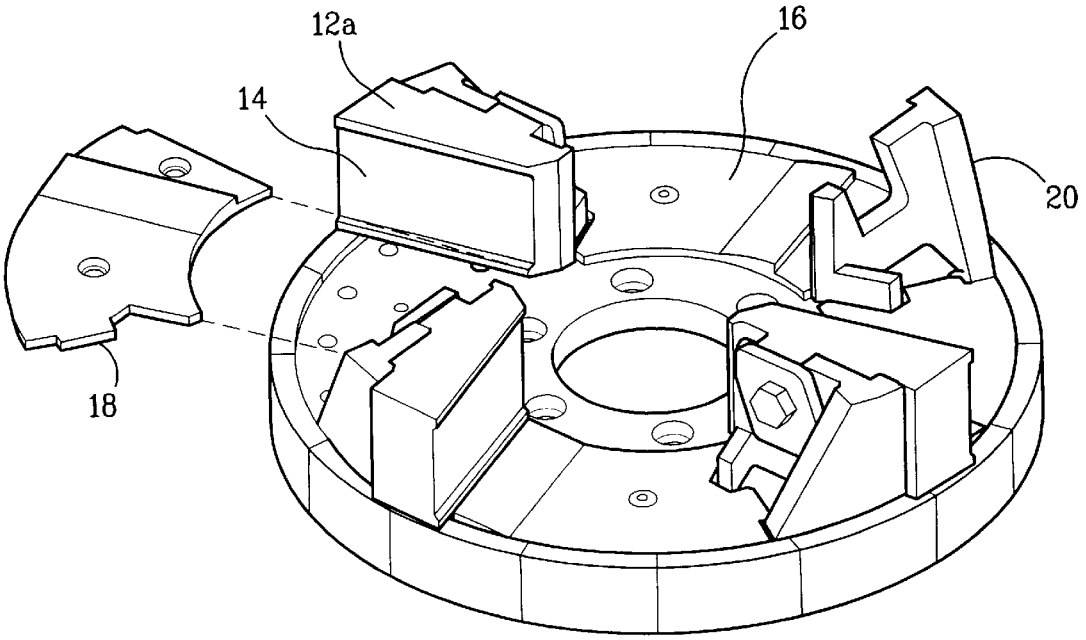
FIG. 4 is a perspective view of typical components of an impeller assembly of an impact crusher.

Bore 24 may be formed in body 12, through first surface 22, by a variety of techniques well known in the art, including drilling, reaming, countersinking or incision by thermal means. In one embodiment of the present invention, bore 24 does not extend through body 12. Bore 24 is formed with an inner face 28 and an edge 28 formed between inner face 28 of bore 24 and first surface 22 of plate 10. Bore 24 formed in body 12 also provides a first surface opening 32 and, as shown in FIG. 2, bore 24 is formed with a closed bottom 34. While the accompanying drawing discloses pattern of bores 26 configured to be equidistant from axes 36*a,b* through the centers of first surface openings 32 of pattern of bores 24, pattern of bores 26 is merely one embodiment of a pattern of bores 26, is not intended to be exclusive, and is not a limitation of the present invention. As shown by cross-reference between FIGS. 2 and 3 in the accompanying drawing, while one embodiment of one or more bores 24 formed in body 12 is formed with closed bottom 34, yet another embodiment of the present invention shows bore 24 in FIG. 3. FIG. 3 shows bore 24 formed in body 12 through first surface 22 of body 12 to extend through body 12 to form a second edge 38 between inner surface 28 of bore 24 and second surface 40 of body 12, and to form a second surface opening 42 in second surface 40 of body 12.

A plate 10 for reducing wear by a material flow, according to the present invention, also includes at least one rod 44. Rod 44 has a distal end 46 and a proximal end 48. The accompanying drawing discloses in FIGS. 2 and 3 one or more rods 44*a,b* in which distal end 46 is rounded or hemispherical. However, as will be evident to one skilled in the art, the shape of distal end 46 of rod 44 is not a limitation on this invention.

Proximal end 48 of rod 44, according to the present invention, is designed to be secured immovably in bore 24. As shown by cross reference between FIGS. 1,2 and 3, proximal end 48 of rod 44 is not altered in shape from the general shape of bore 24. However, as shown in FIG. 2, rod 44 may be provided with threads 50*a*, and inner surface 28 of bore 24 may be provided with threads 50*b* to mate with threads 50*a* of rod 44, and rod 44 and bore 24 may be threadably engaged. As further shown on FIG. 3 of the accompanying drawing, proximal end 48 of rod 44 may extend to second edge 38 in second surface 40 of body 12. In an alternative embodiment, also shown in FIG. 3, proximal end 48*a* of one or more rods 44 may extend a first distance 52 beyond second edge 38 in second surface 40 of body 12. In yet another embodiment of the present invention, proximal end 48 of one or more rods 44 may extend a second distance 54 beyond second edge 38 in second surface 40 of body 12, and be formed substantially as distal end 46 is formed to reduce wear by material flow over, across, under and around second surface 40.

To achieve the objects of the present invention, as shown in FIG. 2, proximal end 48 of rod 44 is inserted into bore 24 of body 12 to position distal end 46 of rod 44 a distal end distance 56 beyond first surface 22 of body 12. Distal end distance 56 by which distal end 46 extends beyond first surface 22 of body 12 is not fixed or uniform, and is not a limitation of the present invention. Also, if more than one rod 44 is inserted into more than one bore 24 of first surface 22 exposed to a material flow, distal end distance 56 in pattern of bores 24 need not be uniform in accordance with the present invention. The capacity of plate 10, according to the present invention, to reduce wear by a material flow is not solely affected by the dimension of distal end distance 56. The effectiveness of plate 10, according to the present invention, to reduce wear by a material flow, is a function in part of distal end distance 56, as well as the design, shape, configuration and location of the plate 10 in relation to angles of incidence of a material flow against, over and around plate 10, and the alloy composition of rod 44. In accordance with one embodiment of the present invention, rod 44 is dimensioned to have a tolerance or interference fit when inserted into bore 24. The interference fit achieves the objective of the present invention.

An embodiment of plate 10 for reducing wear by a material flow, according to the present invention, provides for at least one rod 44 in a pattern of bores 24 to be manufactured by powder metallurgy techniques. However, manufacture of one or more rods 44 by powder metallurgy techniques is merely one embodiment of rod 44 in connection with the present invention, is not intended to be exclusive, and is not a limitation of the present invention. Thus, rod 44 may be manufactured by combining a powder such as tungsten carbide with a binder such as cobalt, nickel or other similar chemical compositions. The powder and binder may be blended and compacted in a press or similar device. The resulting compacts provided by pressing the powder and binder may be sintered in substantially a vacuum, at temperatures from about 1300 degrees Centigrade to 1500 degrees Centigrade, in an atmosphere composed typically of hydrogen and argon, and hydrogen, argon and other gases.

Body 12, according to the present invention, is composed primarily of ferrous materials. However, use of a ferrous material is merely one embodiment of the materials which may be used to compose body 12 of plate 10, is not intended to be exclusive, and is not a limitation of the present invention.

The novel features of this invention, and the invention itself, both as to structure and operation, are best understood from the accompanying drawing, considered in connection with the accompanying description of the drawing, in which similar reference characters refer to similar parts, and in which:

While the particular plate for reducing wear of a material flow as shown and disclosed in detail in this instrument is fully capable of obtaining the objects and providing the advantages stated, this disclosure is merely illustrative of the presently preferred embodiments of the invention, and no limitations are intended in connection with the details of construction, design or composition other than as provided and described in the appended claims.

What is claimed is:

1. An impeller for a centrifugal rock crusher, said impeller comprising:

a body having a first surface for receiving and hurling aggregate toward anvils and a second surface for mounting said body on a rotatable impeller assembly, and wherein said body has a plurality of bores formed therein through said first surface; and a plurality of rods, each rod having a distal end and a proximal end, said proximal ends of said rods being inserted in said bores, and said proximal ends being immovably secured in said bores, and said distal ends of said rods being positioned a distance beyond said first surface of said body, and wherein said rods are interference press fit into said bores, such that said rods are secured in said bores by pressure.

2. An impeller as recited in claim 1, wherein said body is a ferrous metal.

3. An impeller for a centrifugal impact crusher, said impeller comprising:

an impeller shoe body having a first surface for receiving and hurling aggregate toward anvils, said first surface being exposed to aggregate flow during operation of said impact crusher, and means for mounting said impeller shoe body on a rotatable impeller assembly, and wherein said impeller shoe body has a plurality of bores formed therein through said first surface; and a plurality of rods, each rod having a proximal end and a distal end, and wherein said proximal ends of said rods are interference press fit in said bores, such that said rods are immovably secured in said bores, with said rods being in compression within said bores, and wherein said distal ends of said rods are positioned a distance beyond said first surface of said impeller shoe body.

4. An impeller as recited in claim 3, wherein said bores are substantially cylindrical.

5. An impeller as recited in claim 4, wherein said impeller shoe body has a second surface for resting on the rotatable impeller assembly, and wherein said second surface is located between said first surface and said mounting means.

* * * * *